US006027392A

United States Patent [19]

Ruhlman

[11] Patent Number: 6,027,392

[45] Date of Patent: Feb. 22, 2000

[54] AMUSEMENT DEVICE FOR COLLECTING AND STORING SECRETS

[76] Inventor: Maegan Ruhlman, 13211 Lakeshore Blvd., Bratenahl, Ohio 44108

[21] Appl. No.: 09/023,292

[22] Filed: Feb. 13, 1998

Related U.S. Application Data

[60] Provisional application No. 60/038,165, Feb. 13, 1997.

[51] Int. Cl.[7] ..... A63H 33/04; B65D 1/24

[52] U.S. Cl. ..... 446/75; 220/502

[58] Field of Search ..... 446/75, 76, 81, 446/74, 71, 8, 9, 10, 13, 166, 168, 170; 220/501, 502, 524, 820, 821, 824; 206/366

[56] References Cited

U.S. PATENT DOCUMENTS

| | | | |
|---|---|---|---|
| 1,226,634 | 5/1917 | Briese | 220/502 |
| 1,251,870 | 1/1918 | Denzer | 220/502 |
| 1,607,579 | 11/1926 | Thompson, Jr. | 220/502 |
| 2,033,042 | 3/1936 | Mazzella | 220/821 |
| 2,323,036 | 6/1943 | Hanson | 220/502 X |
| 2,531,503 | 11/1950 | Dick | 220/502 |
| 2,612,896 | 10/1952 | Fox | 220/502 |
| 3,169,679 | 2/1965 | Hunter | 220/821 X |
| 5,094,621 | 3/1992 | Friedel | 434/236 |
| 5,180,079 | 1/1993 | Jeng | 220/524 X |
| 5,324,201 | 6/1994 | Friedel | 434/236 |
| 5,823,380 | 10/1998 | Cox | 220/502 |

*Primary Examiner*—D. Neal Muir

*Attorney, Agent, or Firm*—Fay, Sharpe, Fagan, Minnich & McKee, LLP

[57] ABSTRACT

The present invention relates to an amusement device for collecting and storing secrets. The device includes two chambers, each chamber having an opening, which leads into the chamber. Each opening has an associated latch for covering and uncovering the opening. Secrets can be communicated to and collected in the device when the openings are uncovered and stored when the openings are covered.

16 Claims, 2 Drawing Sheets

AMUSEMENT DEVICE FOR COLLECTING AND STORING SECRETS

CROSS REFERENCE TO RELATED APPLICATIONS

This application claims the benefit of U.S. Provisional Patent Application Ser. No. 60/038,165, filed Feb. 13, 1997.

BACKGROUND OF THE INVENTION

1. Field of the Invention

The present invention relates to amusement devices for young children, and more particularly, to a toy for collecting and storing secrets thereby prompting and promoting a child's imagination, motor skill development and cognitive development.

2. Description of the Prior Art

In recent years, parents and educators have become more cognizant of the use of toys in stimulating the cognitive development and imagination of young children. The best toys are recognized as those that stimulate children's cognitive and creative development, with no dangerous side effects. In addition, they are inexpensive, decorative, and easy to use.

It is also well-recognized that children, in an effort to obtain independence and self-reliance, like to keep secrets, particularly from their parents. But there are no known toys, which promote the overall development of a child by allowing for the collection and storage of secrets, while simultaneously stimulating the imagination.

As such, there is a continuing need for a new and improved toy for young children, which enhances the productive and effective enrichment of a child's imagination by allowing for the collection and storage of secrets.

SUMMARY OF THE INVENTION

The present invention provides an amusement device for young children in the form of a toy for collecting and storing secrets, which is simply constructed, easy to use, inexpensive, and encourages the stimulation of a child's imagination and overall development.

According to a first aspect of the invention, an amusement device for collecting and permanently storing secrets is disclosed. The amusement device comprises a first chamber having a first set of sidewalls and a bottom piece sealingly-connected to the lowermost portion of the sidewalls. The first chamber receives the secrets for permanent storage therein. A dividing wall is sealingly-connected to the uppermost portion of the first set of sidewalls. The wall has an opening formed therein. A first latch is pivotally mounted to one surface of the wall at a first pivot point. The latch has a first extending end portion and a front portion. Movement of the end portion of the first latch covers and uncovers the first opening with the front portion of the first latch so that secrets can be collected in the first chamber when the first opening is uncovered and stored when the first opening is covered.

According to a second aspect of the invention, the amusement device for collecting and permanently storing secrets also includes a second chamber having a second set of sidewalls and a top piece sealingly-connected to the uppermost portion of the second sidewalls. The wall is sealingly-connected to the lowermost portion of the second sidewalls to form a second chamber. The top piece has a second latch pivotally mounted to one surface of the top piece. The second latch has a second extending end portion and a front portion so that movement of the end portion of the second latch covers and uncovers the second opening with the front portion of the second latch so that secrets can be collected in the second chamber when the second opening is uncovered and subsequently transferred to the first chamber for permanent storage therein.

According to a third aspect of the invention, a toy for storing secret messages is disclosed. The toy comprises a cup-shaped chamber, a wall and a generally cylindrical chamber. The cup-shaped chamber, cylindrical chamber and wall are sealingly-connected to form a container having two separate compartments. The wall has a first opening formed in the top surface and a first latch pivotally mounted to the top surface. The first latch is of a sufficient surface area to cover the first opening upon movement of one end of the first latch. The generally cylindrical chamber has a second opening formed in its top surface and a second latch pivotally mounted to the top surface. The second latch is of a sufficient surface area to cover the second opening upon movement of one end of the second latch. A secret message can be collected in a compartment when the first or second opening is uncovered and stored in a compartment when the first or second opening is covered.

One advantage of the present invention is that a child's toy is provided, which stimulates the imagination and overall cognitive development of a child by providing for the collection and storage of secret thoughts.

Still a further advantage of the present invention is that a child's toy is provided, which encourages self-reliance and independence by providing for the collection and storage of secret thoughts.

Still another advantage of the present invention is that a toy is provided, which can be used by a child to store his or her secret thoughts.

Still a further advantage of the present invention is that a child's toy is provided, which is simple to manipulate.

Still another advantage of the present invention is that a child's toy is provided, which can be simply and economically manufactured.

Still other benefits and advantages of the present invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
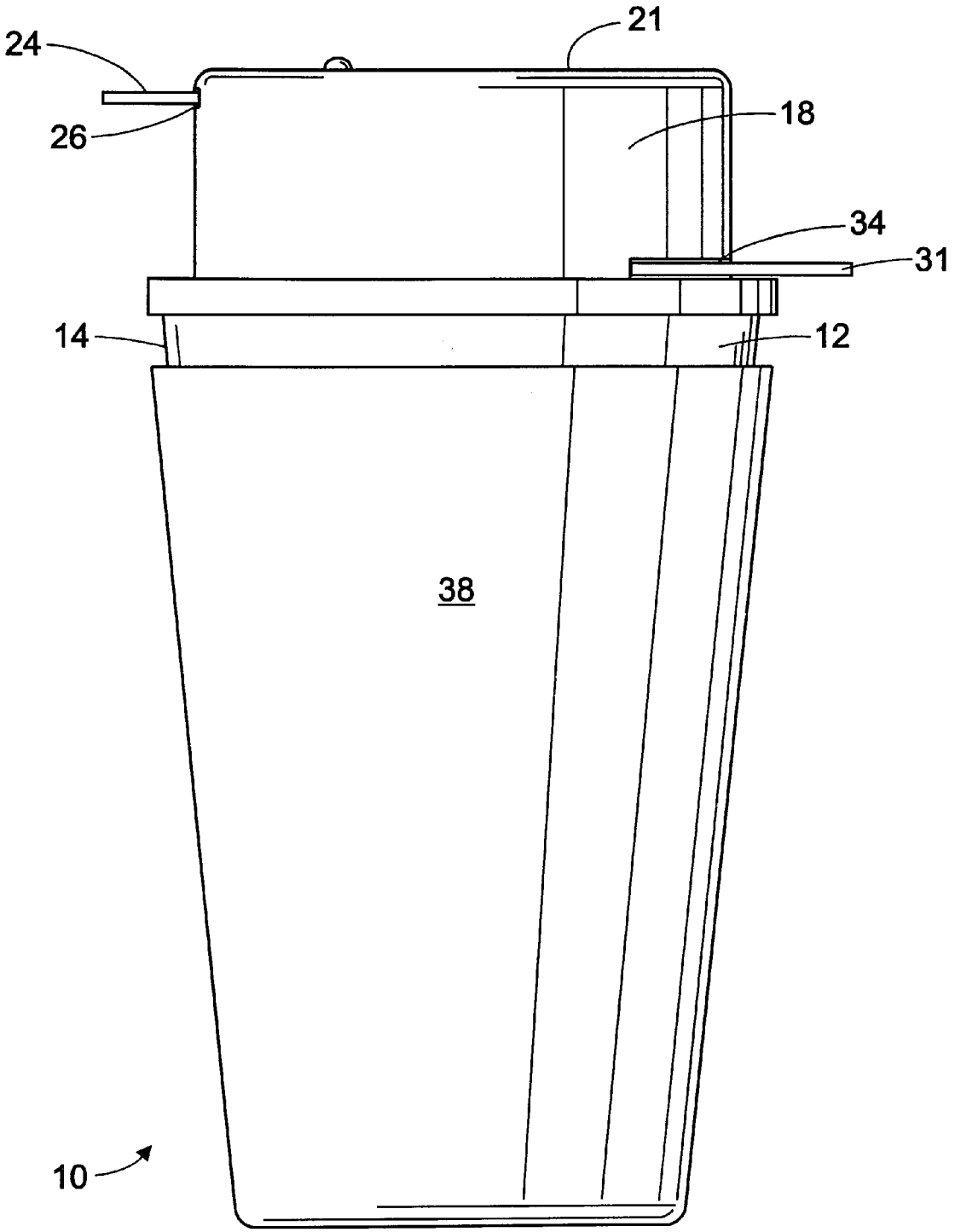
FIG. 1 is a perspective view of the amusement device constructed in accordance with the present invention.

Referring now to the drawings wherein the showings are for the purposes of illustrating the preferred embodiment of the invention only and not for purposes of limiting same, FIG. 1 illustrates the toy storage container 10 of the present invention. The container includes a housing or first chamber 12, which ultimately retains the secrets for storage therein.

Figure 2:
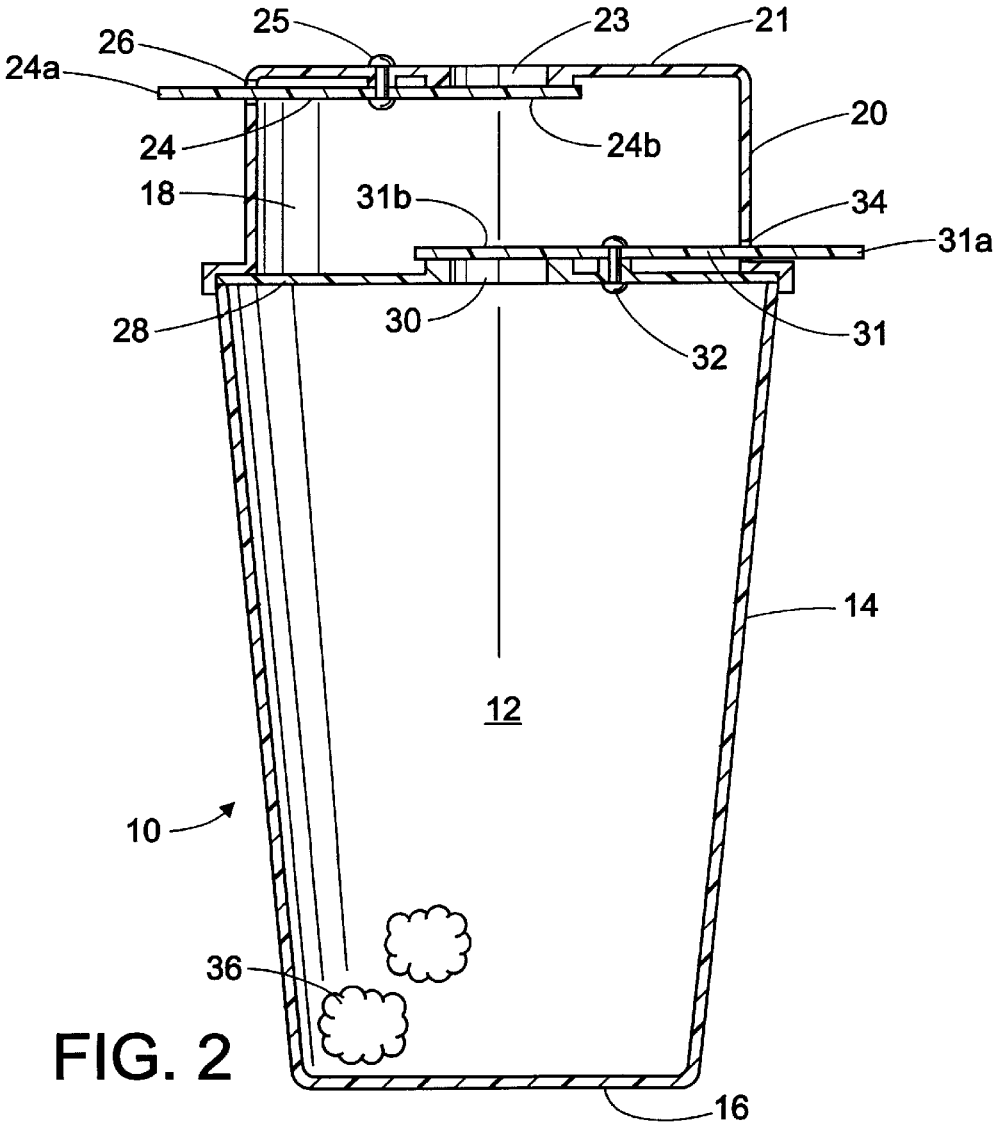
FIG. 2 is a cross-sectional view of the amusement device.

As is best illustrated in FIG. 2, the first chamber 12 includes sidewalls 14 and a bottom surface 16. In the preferred embodiment, the first chamber 12 has a tapered shape. But those skilled in the art would recognize that the shape of the first chamber 12 could also be rectangular, cubic, cylindrical or the like.

The first chamber 12 is preferably formed of a thermoplastic resin. By "thermoplastic resin" it is meant a material with a linear macromolecular structure that will repeatedly soften when heated and harden when cooled. Examples of suitable thermoplastic resins for use in forming the first chamber 12 would include polyethylene, polypropylene, polystyrene, poly(vinyl chloride) (PVC), acrylics, cellulosics, acrylonitrile-butadiene-styrene (ABS), acetal resins, polyamides, polycarbonate, polyesters, poly (phenylene sulfide) (PPS), polysulfone, polyetherether ketone (PEEK) and liquid crystal polymer (LCP). As can be readily appreciated, the first chamber 12 could also be formed of glass, cardboard, wood, steel or like materials.

Figure 3:
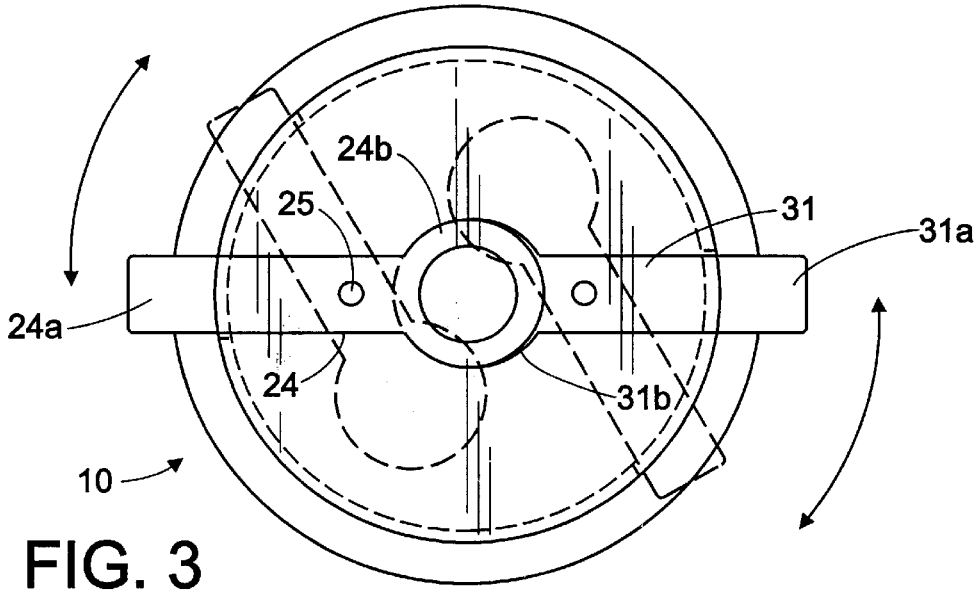
FIG. 3 is a top view of the amusement device.

The toy storage container 10 also includes a second chamber 18. The second chamber 18 is preferably of a cylindrical shape, but may also be rectangular, cubic, hemispherical, triangular, tapered or the like. The second chamber 18 has sidewalls 20 and a top surface 21. The top surface 21 has a first opening 23 formed therein, which is covered by a first latch or valve 24. Preferably, the first opening 23 has a circular cross-section but, alternatively, may also have other various cross-sections, including, but not limited to, square, rectangular, triangular, and diamond. Latch 24 is pivotally mounted on the underside of the upper surface 21 at pivot point 25. Latch 24 includes a rectangularly extending end portion 24*a* and a circular front portion 24*b*. The extending end portion 24*a* extends through sidewall 20 at a first slot 26 formed in one side of sidewall 20. As is best illustrated in FIG. 3, when the extending end 24*a* is moved from side to side, the opening 23 is covered and uncovered by the circular front portion 24*b*. Preferably, the front portion 24*b* of the latch 24 has a cross-section similar or identical to that of the opening 23. For example, the front portion 24*b* and opening 23 have a circular cross-section in the preferred embodiment. Regardless of the shape of the front portion 24*b*, its surface area must be of a size sufficient to cover the entire first opening 23.

The secret-keeping container 10 also includes a dividing wall 28, which separates the container 10 into two separate compartments. A second opening 30 is formed in the top surface of the dividing wall 28. A second latch 31 is pivotally mounted to the top surface of the dividing wall 28 and is pivoted about pivot point 32. The second latch 31 also includes a rectangularly extending end portion 31*a*, which extends through the sidewall 20 at slot 34. The second latch 31 also includes a circular front portion 31*b*. As the extending end portion 31*a* is moved from side to side, the second opening 30 is covered and uncovered by the front portion 31*b* as is best illustrated in FIG. 3.

The openings 23, 30 are preferably positioned in the container 10 so that opening 30 is directly beneath opening 23. The openings 23, 30 are preferably of identical shape and size. The latches 24, 31 are also preferably identical in shape and size.

In the preferred embodiment, the second chamber 18 and the dividing wall 28 are formed of a thermoplastic resin. Suitable examples of the resin would be identical to those previously designated for the first chamber 12. Preferably the plastic material is transparent so that the positioning of latches 24, 31 can be easily ascertained at all times. In the preferred embodiment the second chamber 18 and dividing wall 28 are formed of the same thermoplastic material. The first chamber 12 is preferably formed of an opaque thermoplastic material.

The secret-keeping container 10 of the present invention works as follows: First, both latches 24, 31 must be examined to insure that each is in a closed or covered position. Then latch 24 is pivotally opened to reveal the first opening 23. A secret is then communicated to and collected in the second chamber 18.

There are various ways to communicate the secret to the secret-keeping container 10. For example, the secret could be verbally communicated using a child's voice. In this regard, the child's imagination is stimulated in that the child must imagine that the verbal communication—the secret—travels into and is initially contained in the second chamber 18. Alternatively, as illustrated in FIG. 2, the secret could be written down on a piece of paper 36, which would be subsequently folded or crumpled and placed in the first opening 23 for collection in the second chamber 18.

Next, the first latch 24 is closed, followed by opening the second latch 31. Once the second latch 31 is opened, the secret collected in chamber 18 can be collected and stored in the first chamber 12. With respect to a verbally disclosed secret, a child imagines that the secret is carried into the first chamber 12 from chamber 18 by the force of gravity. Alternatively, the piece of paper 36 containing the written secret could be transferred and stored in the first chamber 12 by manipulation of the container 10 so that the paper falls into the second opening 30 by the force of gravity. The manipulation of the container 10 in this manner would aid in the child's overall fine motor skill development.

As illustrated in FIG. 1, the secret-keeping container 10 may also optionally include a generally cylindrically shaped container 38, which fits snugly to the outside periphery of the first chamber 12. The shape of the container 38 would vary depending upon the overall configuration of first chamber 12. In this regard, the shape of container 38 would typically be dictated by the shape of the first chamber 12.

Also, the outer sidewalls of the first chamber 12 or container 38 could be decorated with assorted arbitrary and fanciful shapes, which are pleasing to the eyes. It is contemplated that no two secret-keeping containers would have the same design thereby highlighting the fact that each is different and unique—just like the children who would play with the containers.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An amusement device for collecting and permanently storing secrets, which comprises:

a first chamber having a first set of sidewalls and a bottom piece, said bottom piece sealingly-connected to the lowermost portion of said sidewalls, said first chamber receiving said secrets for permanent storage therein;

a dividing wall sealingly-connected to the uppermost portion of said first set of sidewalls, said wall having a first opening formed therein;

a first latch pivotally mounted to one surface of said dividing wall at a first pivot point, said latch having a first extending end portion and a front portion, movement of said end portion of said first latch covering and uncovering said first opening with said front portion so that secrets can be collected in said first chamber when said first opening is uncovered and stored when said first opening is covered; and a second chamber having a second set of sidewalls and a top piece, said top piece sealingly-connected to the uppermost portion of said second sidewalls, said dividing wall sealingly-connected to the lowermost portion of said second sidewalls to form said second chamber, said top piece having a second opening formed therein, placement of said second opening in said top piece coinciding identically with the placement of said first opening in said dividing wall so that said second opening is positioned directly above said first opening, said top piece also having a second latch pivotally mounted to one surface thereof, said second latch having a second extending end portion and a front portion, movement of said end portion of said second latch covering and uncovering said second opening with said front portion so that secrets can be collected in said second chamber when said second opening is uncovered.

2. The amusement device of claim 1 further comprising:

a pair of slots disposed in opposite sidewalls of said second chamber, said first end portion of said first latch extending through one of said slots, said second end portion of said second latch extending through the other of said slots.

3. The amusement device of claim 1 wherein said second chamber and said wall are formed of a transparent material and said first chamber is formed of an opaque material.

4. The amusement device of claim 1 wherein said front portions of said first and second latch are of a sufficient surface area to cover said first and second opening.

5. The amusement device of claim 1 wherein said first chamber is a cup.

6. The amusement device of claim 1 wherein said dividing wall is a lid.

7. The amusement device of claim 1 wherein said first and second openings are of a circular cross-section.

8. The amusement device of claim 7 wherein said first and second front portions of said first and second latches are of a circular cross-section.

9. The amusement device of claim 1 wherein said first and second end portions of said first and second latches are moved from side to side to cover and uncover said first and second openings.

10. A toy for storing secret messages, which comprises;

a cup-shaped chamber having an outer periphery;

a dividing wall having a first opening formed in the top surface thereof, said wall having a first latch pivotally mounted to said top surface, said first latch of a sufficient surface area to cover said first opening upon movement of one end of said first latch; and a generally cylindrical chamber having a second opening formed in the top surface thereof, said second opening of the same size as said first opening and juxtaposed in said top surface of said cylindrical chamber directly above and parallel to said first opening, said second chamber having a second latch pivotally mounted to said top surface, said second latch of a sufficient surface area to cover said second opening upon movement of one end of said second latch, said cup-shaped chamber, cylindrical chamber and dividing wall sealingly-connected to form a container having two separate compartments such that secret messages can be transferred into a compartment when said first or second opening is uncovered and stored in a compartment when said first or second opening is covered.

11. The toy of claim 10 further comprising:

a second cup-shaped chamber snugly fitted around the outer periphery of the first cup-shaped chamber.

12. The toy of claim 10 wherein each of said first and second latches includes a front portion having a circular cross-section.

13. The toy of claim 10 wherein said cup-shaped chamber is a cup.

14. The toy of claim 10 wherein said first and second latches are mounted to the underside of said top surfaces.

15. The toy of claim 13 wherein the generally cylindrical chamber is a one-piece molded lid.

16. The toy of claim 15 wherein the lid has an edge piece for mating with said cup.

* * * * *